US010302083B2

(12) United States Patent
Downton

(10) Patent No.: US 10,302,083 B2
(45) Date of Patent: May 28, 2019

(54) MOTOR CONTROL SYSTEM

(71) Applicant: Schlumberger Technology Corporation, Sugar Land, TX (US)

(72) Inventor: Geoffrey C. Downton, Stroud (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 292 days.

(21) Appl. No.: 14/653,702

(22) PCT Filed: Dec. 16, 2013

(86) PCT No.: PCT/US2013/075390

§ 371 (c)(1),
(2) Date: Jun. 18, 2015

(87) PCT Pub. No.: WO2014/099783

PCT Pub. Date: Jun. 26, 2014

(65) Prior Publication Data

US 2016/0195087 A1 Jul. 7, 2016

Related U.S. Application Data

(60) Provisional application No. 61/739,631, filed on Dec. 19, 2012.

(51) Int. Cl.
*F04C 15/00* (2006.01)
*F04C 14/26* (2006.01)
(Continued)

(52) U.S. Cl.
CPC ..... *F04C 15/0084* (2013.01); *E21B 4/02* (2013.01); *E21B 43/129* (2013.01); *F03B 13/02* (2013.01);
(Continued)

(58) Field of Classification Search
CPC ..... F04C 14/26; E21B 4/02
See application file for complete search history.

(56) References Cited

U.S. PATENT DOCUMENTS 3,754,835 A 8/1973 Ivanov et al.
3,840,080 A 10/1974 Berryman
(Continued)

FOREIGN PATENT DOCUMENTS

CN 1628207 A 6/2005
GB 800299 A 8/1958
(Continued)

OTHER PUBLICATIONS

International Search Report for International Application No. PCT/US2013/075390 dated Mar. 20, 2014.
(Continued)

*Primary Examiner* — D. Andrews
*Assistant Examiner* — Jonathan Malikasim

(57) ABSTRACT

A technique facilitates control over the actuation of a device by utilizing a rotor and a corresponding stator system. The rotor is rotatably mounted in the stator system, and rotation of the rotor relative to the stator system is correlated with the volumetric displacement of the fluid passing between the rotor and the stator system. A control system is employed to control the angular displacement and/or torque of the rotor and/or the flow of fluid thereto.

24 Claims, 8 Drawing Sheets

(51) Int. Cl.

| | |
|---|---|
| ***F04C 13/00*** | (2006.01) |
| ***E21B 43/12*** | (2006.01) |
| ***F04C 2/107*** | (2006.01) |
| ***E21B 4/02*** | (2006.01) |
| ***F03B 13/02*** | (2006.01) |

(52) U.S. Cl.
CPC ..... *F04C 2/1075* (2013.01); *F04C 13/008* (2013.01); *F04C 14/26* (2013.01)

(56) References Cited

U.S. PATENT DOCUMENTS

| | | | | |
|---|---|---|---|---|
| 3,912,426 | A | 10/1975 | Tschirky | |
| 5,230,388 | A | 7/1993 | Cherrington | |
| 5,265,682 | A * | 11/1993 | Russell | E21B 4/02 175/45 |
| 5,357,483 | A | 10/1994 | Innes | |
| 5,620,056 | A | 4/1997 | Eppink | |
| 6,109,372 | A | 8/2000 | Dorel et al. | |
| 6,173,771 | B1 | 1/2001 | Eslinger et al. | |
| 6,837,315 | B2 | 1/2005 | Pisoni et al. | |
| 7,234,543 | B2 | 6/2007 | Schaaf | |
| 7,383,898 | B2 | 6/2008 | Downton | |
| 7,757,781 | B2 * | 7/2010 | Hay | E21B 4/02 175/107 |
| 7,975,780 | B2 * | 7/2011 | Siher | E21B 4/02 175/107 |
| 7,987,927 | B2 | 8/2011 | Downton | |
| 8,011,452 | B2 | 9/2011 | Downton | |
| 8,146,679 | B2 | 4/2012 | Downton | |
| 8,967,253 | B2 | 3/2015 | Ciglenec et al. | |
| 2002/0155003 | A1 | 10/2002 | Zupanick et al. | |
| 2003/0127252 | A1 | 7/2003 | Downton | |
| 2005/0109542 | A1 | 5/2005 | Downton | |
| 2006/0086536 | A1 | 4/2006 | Boyle et al. | |
| 2006/0243492 | A1 | 11/2006 | Downton | |
| 2007/0151767 | A1 | 7/2007 | Downton | |
| 2009/0095528 | A1 | 4/2009 | Hay et al. | |
| 2009/0139225 | A1 | 6/2009 | Wang et al. | |
| 2009/0169364 | A1 | 7/2009 | Downton | |
| 2010/0092317 | A1 | 4/2010 | Suhara et al. | |
| 2010/0116551 | A1 | 5/2010 | Southard | |
| 2010/0126774 | A1 | 5/2010 | Downton | |
| 2011/0056695 | A1 | 3/2011 | Downton | |
| 2012/0012396 | A1 | 1/2012 | Downton | |

FOREIGN PATENT DOCUMENTS

| | | | |
|---|---|---|---|
| GB | 2394740 | A | 5/2004 |
| GB | 2408526 | A | 6/2005 |
| GB | 2418456 | A | 3/2006 |
| GB | 2433082 | A | 6/2007 |
| GB | 2439661 | A | 1/2008 |
| GB | 2454880 | A | 5/2009 |
| RU | 250803 | | 8/1969 |
| WO | WO02091554 | A1 | 11/2002 |
| WO | 2004113664 | A1 | 12/2004 |
| WO | 2009067468 | A1 | 5/2009 |
| WO | 2009085753 | A2 | 7/2009 |
| WO | 2009085753 | A3 | 9/2009 |
| WO | 2010061168 | A2 | 6/2010 |
| WO | 2009085753 | A8 | 9/2010 |
| WO | 2010061168 | A3 | 10/2010 |
| WO | 2011030095 | A2 | 3/2011 |
| WO | 2014099783 | A1 | 6/2014 |
| WO | 2014099789 | A1 | 6/2014 |

OTHER PUBLICATIONS

Examination Report 94(3) EPC issued in European Patent Application 13863888.7 dated Sep. 22, 2017. 5 pages.
First Office Action issued in related CN application 201380070820.1 dated Apr. 5, 2016, 11 pages.
International Search report issued in the related PCT application PCT/US2013/075390, dated Mar. 20, 2014. 11 pages.
International Preliminary Report on Patentability issued in PCT application PCT/US2013/075390 dated Jun. 23, 2015. 7 pages.
Second Office Action and Search Report issued in CN app 201380070820.1 dated Dec. 12, 2016.20 pages.
Search Report Rule 62 EPC issued in European Patent Application 13863888.7 dated Sep. 30, 2016. 10 pages.
Office Action issued in Russian Patent Application 2015128810 dated Mar. 2, 2017. 6 pages.

* cited by examiner

MOTOR CONTROL SYSTEM

BACKGROUND

Hydrocarbon fluids such as oil and natural gas are obtained from a subterranean geologic formation, referred to as a reservoir. In a variety of well operations, mud motors are used to convert flowing mud into rotary motion. The rotary motion can be used to drive a drill bit during a drilling operation. Mud motors generally are designed as Moineau motors, i.e. progressing cavity motors, which employ a helical rotor within a corresponding stator. The helical rotor is rotated by fluid flow through the mud motor between the helical rotor and the corresponding stator.

SUMMARY

In general, the present disclosure provides a system and method for controlling actuation of a device by utilizing a rotor and a corresponding stator system. The rotor is rotatably mounted in the stator system, and rotation of the rotor relative to the stator system is correlated with the volumetric displacement of the fluid passing between the rotor and the stator system. A control system is employed to control the angular displacement and/or torque of the rotor.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to controlling actuation of an actuatable device by employing a progressing cavity assembly. By way of example, the progressing cavity assembly may be in the form of a Moineau assembly utilizing a rotor and a corresponding stator system. The rotor is rotatably mounted in the stator system, and rotation of the rotor relative to the stator system is correlated with the volumetric displacement of the fluid passing between the rotor and the stator system. For example, a progressing cavity motor may be operated by fluid flowed through the progressing cavity motor; and a progressing cavity pump may be operated to cause fluid flow through the progressing cavity pump. A control system is employed to control the angular displacement and/or torque of the rotor.

The control system enables use of the assembly in a wide variety of applications that may utilize a more precise control over angular displacement and/or torque applied to an actuatable device. In some applications, the control system operates in cooperation with a mud motor to form an overall, servo type actuation control system. The overall actuation control system may be used to control the speed and angle of rotation of an output shaft. In many applications, the overall actuation control system may be employed as a high fidelity rotary servo capable of achieving precision angular positioning, angular velocity, and torque output control. In some wellbore drilling operations, the actuation control provided by the mud motor of the overall actuation control system may be combined with the rig pump control system.

Figure 1:
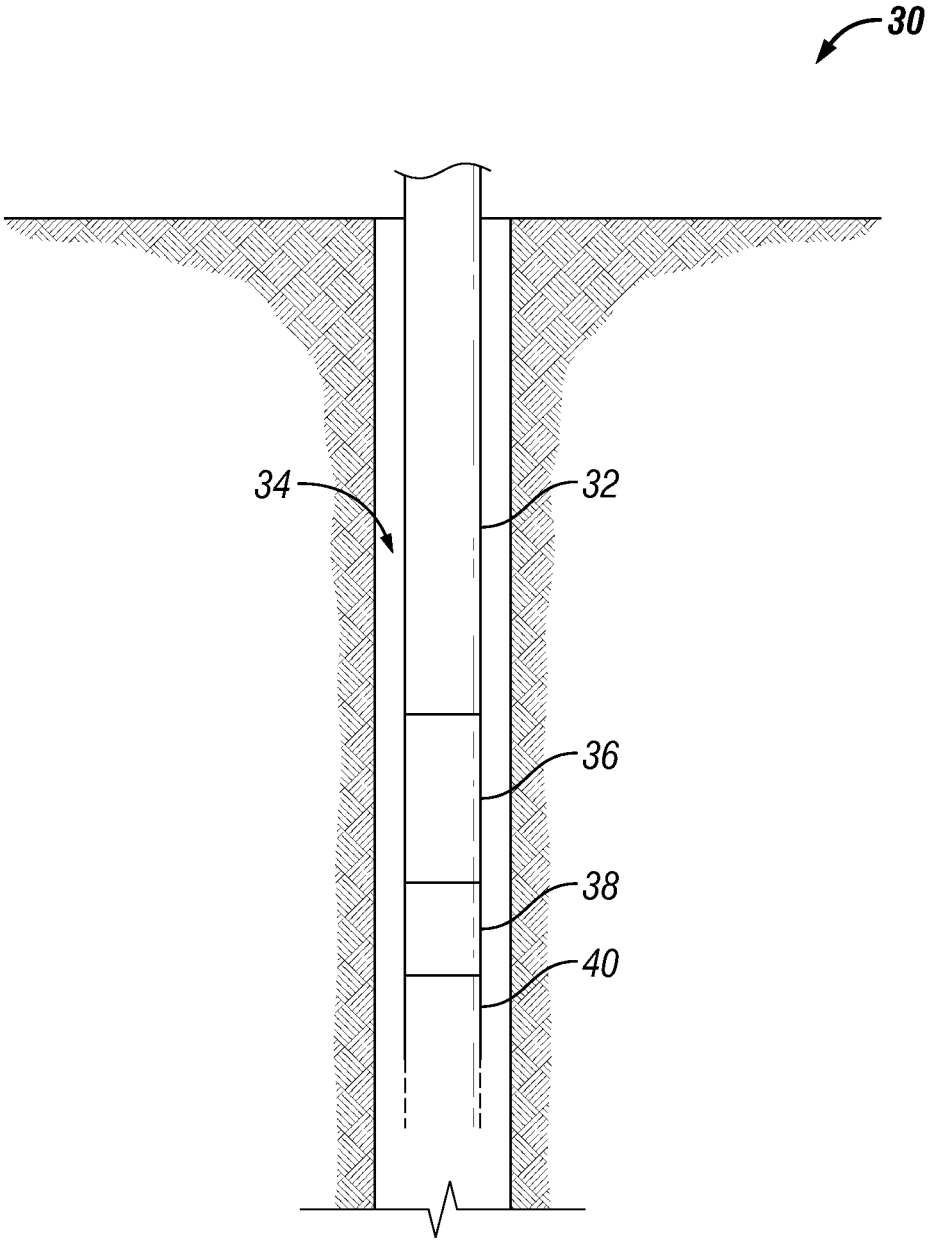
FIG. 1 is a wellsite system in which embodiments of an actuation control system can be employed to control the actuation of an actuatable device, according to an embodiment of the disclosure.

Referring to FIG. 1, an example is illustrated in which an actuation control system is employed in a well operation to control actuation of a well component. However, the actuation control system may be employed in a variety of systems and applications (which are well related or non-well related) to provide control over angular positioning, angular velocity, and/or torque output. The control provided with respect to these characteristics enables use of the actuation control system for actuating/controlling a variety of devices.

In the example illustrated in FIG. 1, a well system 30 is illustrated as comprising a well string 32, such as a drill string, deployed in a wellbore 34. The well string 32 may comprise an operational system 36 designed to perform a desired drilling operation, service operation, production operation, and/or other well related operation. In a drilling application, for example, the operational system 36 may comprise a bottom hole assembly with a steerable drilling system. The operational system 36 also comprises an actuation control system 38 operatively coupled with an actuatable device 40. As described in greater detail below, the actuation control system 38 employs a progressing cavity system, e.g. a mud motor or mud pump system, to provide a predetermined control over actuatable component 40. It should be noted, however, the illustrated arrangement is provided only for purposes of explanation and many other sizes, types and arrangements of components may be employed in a given system. For example, the actuatable component 40 may be of a smaller diameter or size and may be disposed within or partially within the actuation control system 38, e.g. component 40 may be various types of internal components. In other applications, the actuatable component 40 may be located above control system 38 or at other positions with respect to control system 38.

In drilling applications, the actuatable device 40 may comprise a drill bit having its angular velocity and/or torque output controlled by the actuation control system 38. However, the actuation control system 38 may be used in a variety of systems and applications with a variety of actuatable devices 40. By way of example, the actuation control system 38 may be a precision orienter to control the toolface of actuatable device 40 in the form of, for example, a bent housing mud motor. In some applications, the actuation control system 38 may be connected to a measurement-while-drilling system and/or a logging-while-drilling system. System 38 and device 40 also may comprise a mud motor powered bit-shaft servo for controlling a steering system such as the steering systems described in U.S. Pat. No. 6,109,372 and U.S. Pat. No. 6,837,315. In another application, the actuation control system 38 may comprise a mud motor employed to power a mud-pulse telemetry siren. Another example utilizes the mud motor of system 38 as a servoed eccentric offset for a "powered" non-rotating stabilizer rotary steerable system. The actuation control system 38 also may be used to achieve a high level of RPM and torque control over a drill bit for desired rock-bit interaction.

In other applications, the actuation control system 38 may be utilized as an active rotary coupling to isolate actuatable device 40, e.g. to isolate a bottom hole assembly from drill-string transients while still transmitting torque. The progressive cavity system of actuation control system 38 also may be employed as a precision downhole pump for managed pressure drilling and equivalent circulating density control. The system 38 also may comprise a precision axial thruster in which the servoed mud motor drives a lead screw to control actuatable device 40 in the form of a thruster. Similarly, the mud motor of actuation control system 38 may be employed as a power plant for a bottom hole assembly drilling tractor system designed so the high fidelity traction control allows for fine rate of penetration control. In some applications, the actuation control system 38 comprises a frequency/RPM control drive mechanism for driving actuatable device 40 in the form of a hammer system. The system 38 also may be used as a controlled rotary input to an electrical alternator which enables substantial control over speed variations to be maintained in the presence of flow variations. The progressive cavity system of actuation control system 38 also may be employed as a rotary hammer. Accordingly, the actuation control system 38 and the actuatable device 40 may be constructed in a variety of configurations and systems related to well and non-well applications.

In drilling applications, a fluctuation in collar or bit speed can occur during drilling due to torsional disturbances, and such fluctuations, e.g. speed-dips, can cause an accumulation of angular motion errors between the actual motion of the drilling system, e.g. bottom hole assembly, collar, bit, or other system, and the desired angular motion (where motion is construed as position, velocity, acceleration and/or a complex curve). The process of drilling involves many sources of torsional variation that produce a complex wave of disturbances which flow up-and-down a well string and through any mechanism in the well string, such as the various actuatable devices 40 described above. The torque-wave also can cause the pipe work to wind-up, thus causing a stator of a bent-housing mud motor to rotate and further disturb the angular orientation of tool face. In drilling applications, sources of disturbance include reactive torque from the bit, other mud motors in the drill string, drilling through different types of formation, and other environmental and system characteristics. Actuation control system 38 reduces or removes these undesirable angular motions and torques.

The use of actuation control system 38 provides an ability to rapidly "reject" torque disturbances by providing control action local to the point of control (e.g. the bent housing motor) rather than relying on, for example, varying the speed of the surface mud pumps in response to motor speed measurements transmitted by conventional mud pulse telemetry. Mud flows through an entire drilling system so any device in the drill string that chokes or leaks the flow in an irregular fashion also causes pressure fluctuations at the input to any mud actuated device, such as a mud motor, connected to the drill string which, in turn, causes flow variations that result in angular fluctuation of the rotor. Examples of such sources include fluctuation of rig pump speeds, telemetry methods that utilize positive/negative pressure pulses, telemetry downlinks achieved by varying rig pump speeds, opening/closing of under-reamers, on/off bottom contact by the drill bit, other motors in the drill string, ball-drop devices, flow-diversion to the annulus, alteration in drilling mud composition, and other sources. Utilizing the actuation control system 38 downhole rejects and modifies such influences by providing the control local to the progressive cavity motor/pump. In some applications where surface rotation of the drill pipe impacts the fidelity of control, the rig's rotary table can be operated to adjust rotary table rotation to match downhole parameters at the actuation control system 38. However, the local control of the mud motor or other progressive cavity system of the actuation control system 38 enables higher levels of control fidelity.

Figure 2:
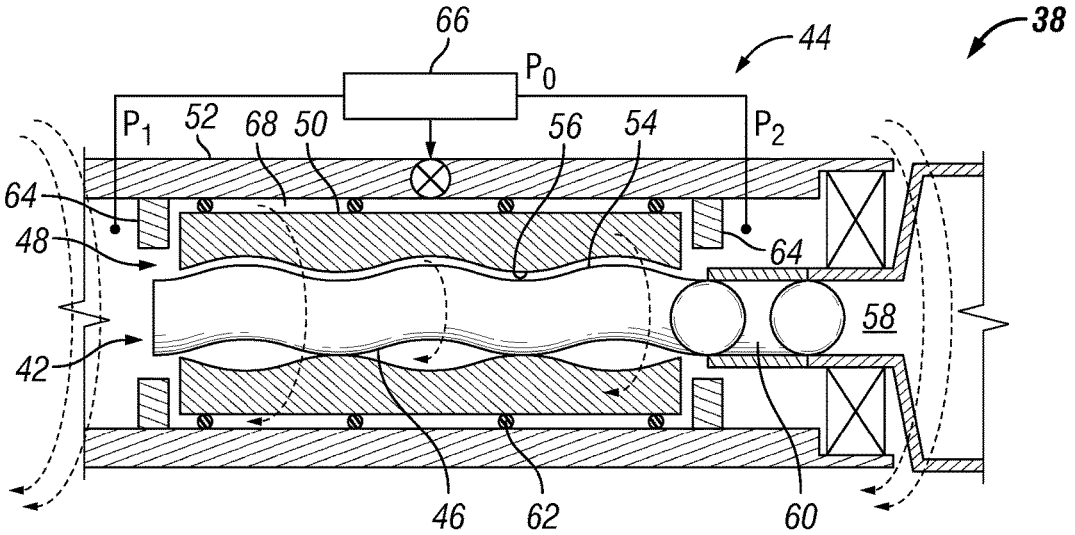
FIG. 2 is a schematic illustration of an example of an actuation control system, according to an embodiment of the disclosure.

Referring generally to FIG. 2, an example of actuation control system 38 is illustrated in the form of a progressive cavity system 42 and an associated local control system 44. Progressive cavity system 42 may be in the form of a progressive cavity motor or a progressive cavity pump depending on the application. In the example illustrated, the progressive cavity system 42 comprises a rotor 46 rotatably received within a stator or stator system 48. The stator system 48 may be designed with a stator can 50 rotatably mounted within a collar 52. The progressive cavity system 42 is designed to allow the powering fluid, e.g. mud, to flow through the progressive cavity system 42, e.g. mud motor, while allowing the stator can 50 to slip within the collar 52 in a controlled fashion via control system 44. It should be noted that the exterior of the rotor 46 and/or the interior of the stator can 50 may be formed of an elastomer. In some applications, however, both the exterior of rotor 46 and the interior of stator can 50 may comprise metal to form a metal-to-metal interaction between the components.

In the example illustrated, the rotor 46 has an external surface profile 54 and the stator can 50 has an internal surface profile 56 that cooperates with the rotor profile 54. For example, if fluid flow is directed between the rotor 46 and the stator can 50, surface profiles 54, 56 cause relative rotation between the rotor 46 and the stator can 50. It should be noted that if progressive cavity system 42 is used as a pump, relative rotation imparted to the rotor 46 and stator can 50 causes pumping of fluid by cooperating surface profiles 54, 56. By way of example, surface profile 54 may be in the form of a helical surface profile, and surface profile 56 may be in the form of a cooperating helical surface profile.

As illustrated, rotor 46 may be coupled to an output shaft 58 by a suitable transmission element 60. Additionally, stator can 50 may be rotatably mounted in collar 52 via a plurality of bearings 62. The illustrated position of bearings 62 is provided as an example, but the bearings may be positioned in a variety of locations. For example, the bearings may be positioned along the length of the stator can 50, at one or both ends of the stator can 50, extending beyond the stator system 48, extending partially between the stator can 50 and the collar 52, and/or at other suitable locations. The rotation or slippage of stator can 50 relative to collar 52 (or relative to another reference point) is controlled via control system 44. By way of example, control system 44 may comprise braking elements 64 designed to grip stator can 50 and to thus control the rotation of stator can 50 relative to, for example, collar 52. The braking mechanisms 64 and/or other braking mechanisms discussed herein may be positioned at a variety of suitable locations. For example, the braking mechanisms 64 may be located along the stator can 50 and/or they may be positioned beyond the ends of the stator can 50. By way of further example, the braking mechanisms may be contained in a separate sub connected to one or both ends of the stator can 50. The material used at the brake contact surface may be made of steel, carbon fiber, aramid fiber composite (e.g. Kevlar, a registered trademark of I.E. DuPont De Nemours), semi-metallic materials in resin, cast iron, ceramic composites, and/or other materials suited for downhole use in, for example, drilling mud or oil-filled environments.

The control system 44 also may comprise a control module 66 which may be a processor-based hydraulic control module or an electrical control module designed to activate braking elements 64 hydraulically or electrically. Depending on the desired control paradigm, pressures $P_1$ and $P_2$ may be used to adjust the pressure within the cavity containing fluid 68, thus modulating the friction between stator can 50 and collar 52. By way of example, the modulation may be through direct contact or via a special brake 64 designed to extend and press against stator can 50 to slow its motion in a desired fashion. For example, the brake 64 may be positioned to act against a contact area at the stator can ends and/or along the stator can length. The braking device 64 also may be selectively coupled to stator can 50 by an inerter, such as the inerter discussed in US Patent Publication 2009/0139225, where the transfer of energy is first converted to momentum of a spinning body rather than being lost as friction. Additionally, energy can be stored in the spinning stator can 50 which provides the stator can 50 with inerter-like properties and enables use of the stator can as an inerter in certain applications. Control system 44 may utilize a variety of other or additional elements to control the slip of stator can 50. In some applications, for example, with suitable sealing and compensation arrangements a magneto-rheological fluid 68 may be located between stator can 50 and collar 52 to selectively limit slippage via controlled changes in viscosity of the fluid 68 through the application of a magnetic field. It will be appreciated that additional systems of power, measurement, sensing, and/or communication may be used in combination with the embodiments described herein.

Figure 3:
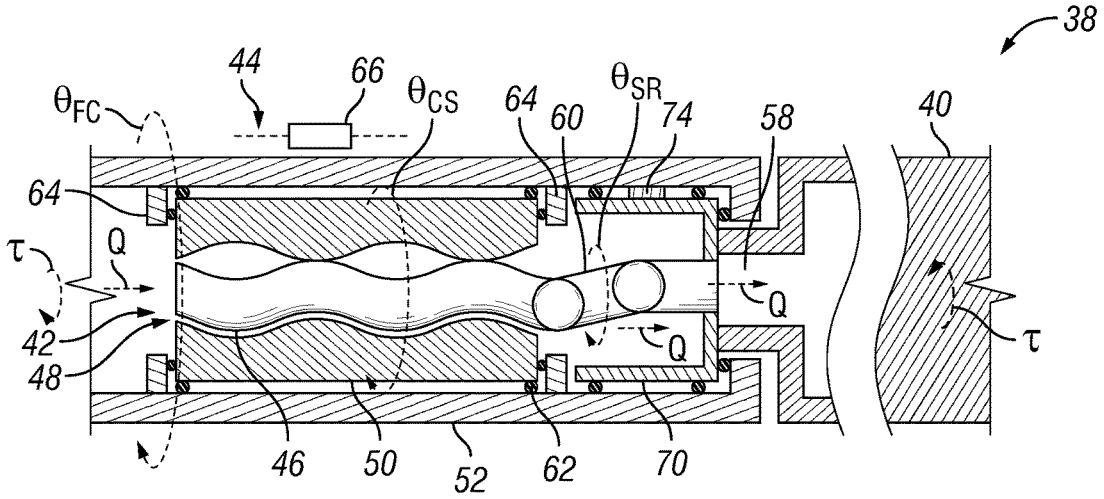
FIG. 3 is a schematic illustration of an example of an actuation control system coupled to an actuatable device, according to an embodiment of the disclosure.

A similar example is illustrated in FIG. 3. In this embodiment, the progressing cavity system 42 is in the form of a mud motor illustrated as coupled with actuatable device 40. In drilling applications, the actuatable device 40 may comprise a drill bit or steering system. However, the actuatable device 40 may comprise a variety of other types of devices for use in drilling applications, other well related applications, and non-well applications, as described above. In this example, the transmission element 60 is guided by a rotatable housing 70 coupled to output shaft 58.

Control over the angular speed, angular position and/or torque output at shaft 58 may be determined via local control system 44 (see also FIG. 4) by controlling the relative slippage of stator can 50 with respect to collar 52. However, the control objective can be quite varied. For example, control system 44 may be used to specifically control the angle of the actuatable device 40 with respect to the collar 52, i.e. $\theta_{CR}=\theta_{CS}+\theta_{SR}$, the angle of the actuatable device 40 with respect to the angle of some distal part of the drill string or other component located below the motor, or another suitable control objective.

With respect to the embodiments illustrated in FIGS. 2 and 3, if the stator can 50 is allowed to spin freely, i.e. there is no torsional coupling between stator can 50 and collar 52, then actuatable device 40 and stator can 50 can spin freely with respect to each other with the rotation of rotor 46 and stator can 50 spinning at whatever speed the mud flow demands. In practice, there will be some frictional drag between stator can 50 and collar 52 and thus there will also be a small torsional coupling between collar 52 and actuatable device 40. Also, the pressure drop ($P_1$-$P_2$) across progressive cavity system 42 will be indicative of the frictional losses between the rotor 46 and stator can 50 and between the stator can 50 and the collar 52.

The relative rotation between the rotor 46 and the stator can 50 is nominally determined by the volumetric displacement of fluid through the motor (ignoring the effects of seal leakage within or round the motor). The relative angular motion of the rotor 46 with respect to the collar 52 has an additional degree of freedom introduced by the stator can slippage. By controlling this slippage, the rotor speed may be controlled relative to the collar 52, relative to the formation, or relative to other references.

The torque reacted or transmitted by the stator can 50 to the collar 52 depends on the torque existing between stator can 50 and collar 52. Similarly, the torque transmitted through the rotor transmission 60 to actuatable device 40 is the same as the torque reacted off the stator can 50. So apart from transients concerned with initial velocity changes in the rotor 46, the stator can 50, or the collar 52, the torque reacted or transmitted by the rotor 46 is the same as that existing between stator can 50 and collar 52—and what exists to be transmitted by the collar 52 itself.

Referring again to FIGS. 3 and 4, the rotation of rotor 46 with respect to the rock formation $\theta_{FR}$ is given by:

$$\theta_{FR}=\theta_{FC}+\theta_{CS}+\theta_{SR} \quad (1)$$

wherein:

$\theta_{FC}$=the angle of the motor collar with respect to the rock formation;

$\theta_{SR}$=the angle of the rotor with respect to the stator can; and $\theta_{CS}$=the angle of the stator can with respect to the collar;

and the rate of change in $\theta_{SR}$ is:

$$d\theta_{SR}/dt \text{ [rads/sec]}=K_V \text{ [rads/m^3]}*Q \text{ [m^3/sec]} \quad (2)$$

where $K_V$ is the constant relating unit rotor to stator rotation to unit volumetric flow and Q is volumetric flow rate.

Figure 4:
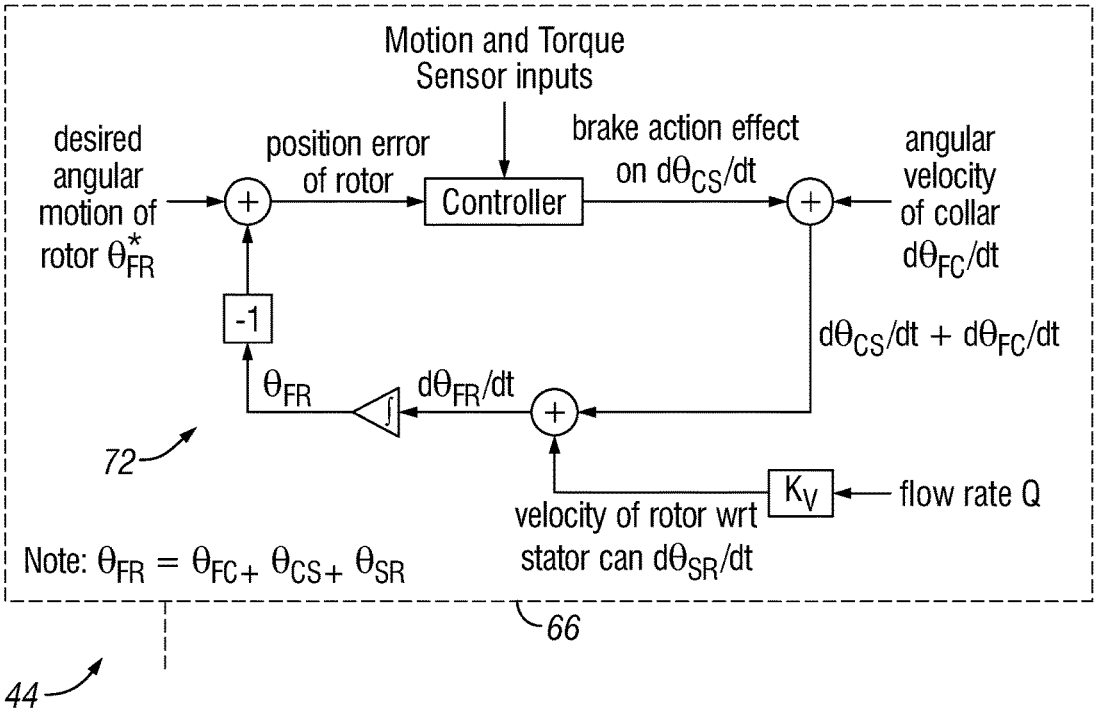
FIG. 4 is a schematic illustration of a controller that may be used with actuation control systems described herein, according to an embodiment of the disclosure.

Given a situation where the collar's rotation with respect to the formation $\theta_{FC}$ and the flow rate Q through the motor are both varying and it is desired to achieve a target setpoint $\theta_{FR*}$ for the rotation of the rotor with respect to the formation (e.g. as may be appropriate for an orienter), the control problem becomes how to dynamically adjust $\theta_{CS}$ by selectively braking the motion of the stator can 50 with respect to the collar 52—(see diagram 72 of FIG. 4 for control loop). It is assumed the mud motor is suitably equipped with angle measuring devices, where appropriate, between the various rotating members, and that those devices are suitably connected by wires or other transmission media to enable transmission of information and power to the relevant control systems and power supply systems. There are many approaches to the controller design depending on the characteristics of the braking mechanism and the system to be controlled. Given that the brake operates between fully on and fully off and the braking torques between those ranges are a function of slip speed, temperature, duration of operation, mud characteristics, brake wear, and other factors, the braking mechanism and the control structure may vary between applications. By way of example, a simple control strategy is to vary the effective braking torque in proportion to the slip velocity multiplied by an amplified version of the extent the desired value $\theta^*_{FR}$ deviates from the actual value $\theta_{FR}$ plus an offset to keep the damping adjustment within upper (on) and lower (off) bounds. At a more complex level, the Back Stepping methods of Kristic "Nonlinear and Adaptive Control Design" Miroslav Krstic, Petar V Kokotovic could be used to develop a real time adaptive control strategy. Similarly, design methods of "L1 Adaptive schemes of L1 Adaptive Control Theory: Guaranteed Robustness with Fast Adaptation" by Naira Hovakimyan and Chengyu Cao could be practiced. The design approach taken in "Adaptive Control of Parabolic PDEs" by Andrey Smyshlyaev & Miroslav Krstic could also be used to account for the partial differential equation characteristics of the distributed and compliant drill string and hydraulic system. If the control objective is, say, to maintain a set level of torque at the bit in the presence of system disturbances that would otherwise perturb this setting, then a simple control strategy is to instrument the bit to measure torque and compare that value to the set-point torque desired and then use a similar gain and offset strategy to modulate the braking effect. By way of example, the control system may be physically distributed between computers at the surface, along the string, or within the bottom hole assembly.

The torque acting through the system is:

$$\tau \text{ [Nm]}=\text{KP [Nm/}Pa\text{]}*(\text{Pin}-\text{Pout})[Pa] \quad (3)$$

where KP=torque [Nm] per unit pressure [Pa] across the motor (ignoring effects such as friction losses, fluid compressibility and inertial accelerations) and Pin is pressure at motor input and Pout is pressure at motor output (or $P_1$ and $P_2$ respectively in FIG. 2).

The torque that has to be reacted between the stator-can and the collar also is $\tau$ [Nm].

This means the power to achieve any angular velocity between collar 52 and stator can 50 $\theta_{CS}$ is:

$$\text{Power}(C,S)[W]=d\theta_{CS}/dt \text{ [rad/sec]}*\tau \text{ [Nm]} \quad (4)$$

Using this type of control over the stator can 50 will create heat. For example, if the desired rotor rotation is half that being provided by the mud flow rate, then an amount of heat energy approximately equal to the power being mechanically transmitted to the system below is dissipated in the system as heat. However, the heat can be dissipated and/or handled in a variety of ways that avoid any detrimental impact on the actuation control system 38. For example, the mud motor/progressing cavity 42 may be designed with thin-walled elastomer technology which uses a mechanically substantial pre-shaped helicoidally shaped metal former onto which the elastomer seal is adhered. The substantial metal former in contact with the fluid provides opportunities to divert heat away from the elastomer and to distribute the energy created along its length. In many applications, the stator system 48 also may be designed as a fairly long structure, e.g. 2 to 10 m, which also provides a greater heat dissipation area. The outer surface area of the stator can 50 next to the collar 52 may be used to dissipate the heat generated through the intervening fluid to the collar wall and then to the mud annulus. Additional leakage paths can also be introduced through the stator can 50 or through its intervening void with the collar 52 to allow the leaked mud to carry heat away. Furthermore, if the elastomer seal is attached to the rotor 46 and not the stator can 50, the effects of friction generated heat within stator can 50 can be further improved. The use of a metal-on-metal motor without the intervening elastomer seal would further improve handling of the deleterious effects of heat.

In many applications, the flow rate and drill string rotation can be set to values that do not require dissipation of substantial amounts of heat energy. For example, the progressing cavity system 42 may be used as part of an orienting sub in which the lower end of the servoed mud motor is substantially geostationary (i.e. $d\theta_{FR}/dt=0$). If the drill string is rotated clockwise and drilling mud is flowed down through the mud motor 42, then dissipated heat may be minimized by constructing the mud motor 42 such that it rotates opposite to convention (i.e. the rotor 46 rotates anti-clockwise looking down hole)

Substituting equation (2) into (1) to find $d\theta_{FR}/dt$ $$d\theta_{FR}/dt=d\theta_{FC}/dt+d\theta_{CS}/dt+K_V*Q \quad (5)$$

To an approximate nominal condition:

$$0=d\theta_{FC}/dt+d\theta_{CS}/dt+K_V*Q \quad (6)$$

Hence, for $d\theta_{CS}/dt$ to be as small as possible:

$$d\theta_{FC}/dt=-K_V*Q \text{ approximately.} \quad (7)$$

At the surface, the drill pipe rotation speed is known so Q can be set to approximately satisfy equation 7. Any imperfections resulting in $d\theta_{FR}/dt$ not equaling zero can be compensated by a suitable stator can slip value of $d\theta_{CS}/dt$ (although the torque could be high, the slip velocity should be low and so limit the heat produced). Stick-slip can sometimes be problematic, but the real time active nature of how the stator can is allowed to slip can be used to dampen such oscillations.

In many situations, it may be beneficial to disable the servo, e.g. disengage braking elements 64, and to activate another braking element 74 to lock the collar 52 to the actuatable device 40 so that $d\theta_{CR}/dt=0$, thus ensuring collar to rotor relative rotation is zero. When braking mechanism 74 is locked and braking mechanism 64 is unlocked, the system will continue to be able to facilitate mud flow at full rate because the stator can 50 is free to spin backwards. Because of the design of the progressive cavity system 42, the motor stator system 48 already is constructed to take full flow and with little pressure drop through it when unloaded. In this case:

$$d\theta_{CR}/dt=d\theta_{CS}/dt+d\theta_{SR}/dt=0 \quad (8)$$

This means that the stator-can 50 is driven according to:

$$d\theta_{CS}/dt=-K_V*Q \quad (9)$$

The ability to permit full flow while disabling the servo may be useful in a variety of applications and situations, e.g. when back reaming, running in, or trying to free a stuck item below the mud motor or other progressive cavity system 42, i.e. the stator can 50 is allowed to spin freely and the torsional load through the servo, e.g. between the rotor 46 and collar 52, is transmitted by the braking mechanism 74.

In situations involving torsional drilling loads acting through the mud motor 42, the braking mechanism 74 may be designed as part of a safety system. For example, the braking mechanism 74 may have a fail-safe condition such that when all power is removed the joint locks automatically. Activation of the locking mechanism 74 also may be controllable by another supervising system, e.g. a driller control system, a SCADA control system, or as part of an interlock scheme. It would be reasonable to design the braking mechanism 74 to be enabled when the flow dropped below a given threshold. There are several places for this braking mechanism 74 to reside. For example, it may be designed to brake the rotor 46 to the collar 52 or it may be designed to brake the drive shaft 58 to the collar 52. In some applications, the actuation control system 38 may be designed without a braking mechanism 74, e.g. when the actuation control system 38 is used as a bit-shaft servo for certain rotary steerable systems or as a servo internal to the collar and oblivious to the collar torques.

It should be further noted that braking mechanisms 64 and 74 can be operated together to improve servo performance. The improved performance may be achieved when, for example, the relative deceleration of actuatable element 40 with respect to the collar 52 is to be enhanced by the braking effect of braking mechanism 74.

Figure 5:
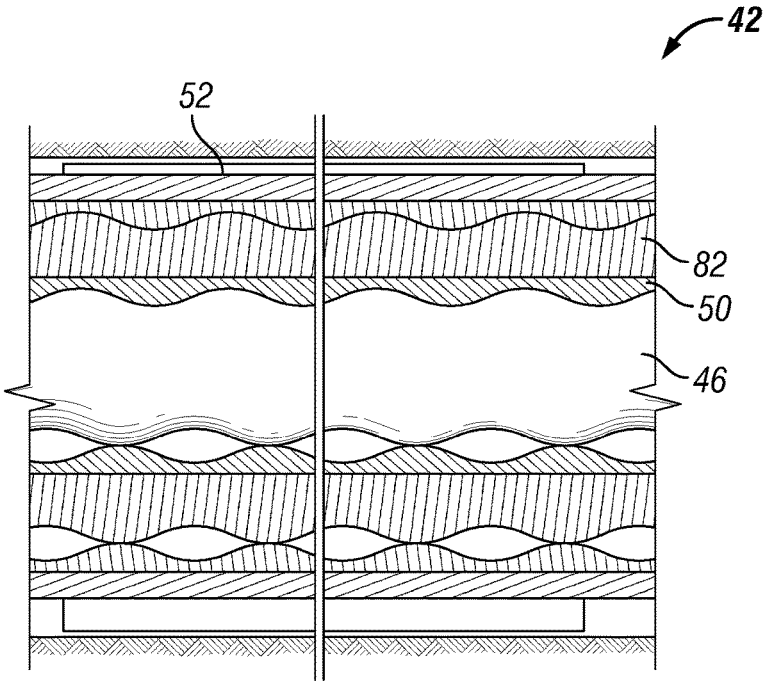
FIG. 5 is a schematic illustration of another example of an actuation control system, according to an embodiment of the disclosure.

Depending on the characteristics of the system and/or application, the control system 44 may utilize a variety of other components and configurations. For example, the control system 44 may be designed to use differential pressures to cause a surface to expand or contract in a void between the collar 52 and the stator can 50 to create another type of pressure controlled friction brake (similarly for braking mechanism 74). The control is in accordance with the set point demand on motion control in control module 66. As discussed above, a magneto-rheological fluid may be interposed between the stator can 50 and the collar 52 (or rotatable housing 70 and collar 52) and may be activated by an electromagnetic field to create a desired viscous drag. As illustrated in FIG. 5, another construction for control system 44 and for utilizing a mud motor as a servo type control involves connecting the stator can 50 to another mud motor 82. The second mud motor 82 acts like a pump when the stator can 50 is rotated in the direction of the prevailing torque, or it acts like a motor when the stator can 50 is rotated in a direction opposite to the prevailing torque.

Figure 6:
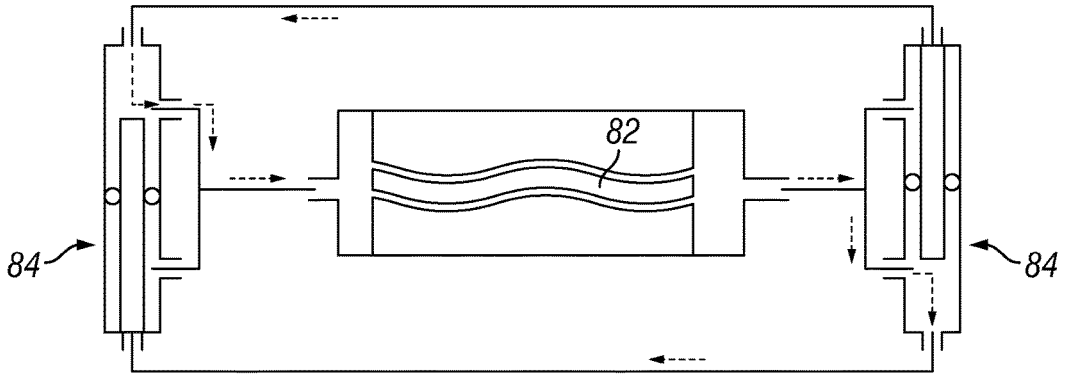
FIG. 6 is a schematic illustration of another example of an actuation control system, according to an embodiment of the disclosure.

In the example illustrated in FIG. 5, the outer, second motor 82 may be controlled by a servo/valve system, as illustrated in FIG. 6. In this embodiment, a pair of valves 84 is used to control operation of the second motor 82. One of the valves 84 controls the supply of fluid, e.g. drilling mud, to one end of the motor 82, and the other valve 84 controls the supply of fluid to the opposite end of the motor 82. The valves 84 may be controlled by, for example, control module 66 such that one valve is open and the other is closed so as to cause the motor 82 to operate in a predetermined direction. In some applications, both valves 84 may be open or both valves may be closed to render the motor 82 inoperative. The high-pressure supply is provided by the mud entering the system and the low-pressure outlet is provided by the annulus. By switching the flow path through motor 82, a wider range of stator can slip velocities can be attained, e.g. positive and negative with respect to the collar 52. An example of such an implementation is described in U.S. Pat. No. 8,146,679.

Figure 7:
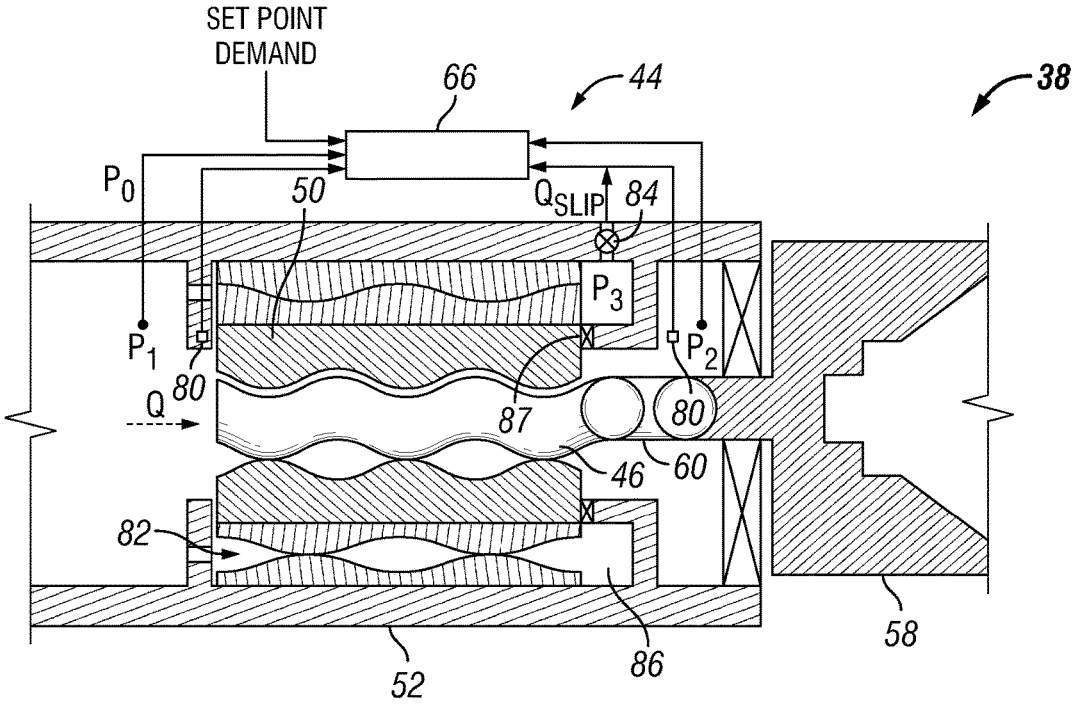
FIG. 7 is a schematic illustration of another example of an actuation control system, according to an embodiment of the disclosure.

Another example utilizing second motor 82 as part of the control system 44 is illustrated in FIG. 7. In this embodiment, the motor-within-motor design is used in a torque-braking arrangement. The speed of the rotor 46 and collar 52 is monitored via sensors 80, and that data is used to control the release of fluid through the outer motor 82 via one of the control valves 84. The top end of the motor 82 is exposed to the mud pressure which causes the motor to turn according to the design of its helical profile as the mud travels through and exits into chamber 86. However, the flow out of chamber 86 is moderated by the illustrated control valve 84 which either ports mud back into the main flow through the motor or out to the annulus according to the magnitude of torque and speed effects desired. Because the two motors are connected, the motors gyrate together and the sealing of chamber 86 is sufficiently tolerant of the lateral motions. By way of example, the chamber 86 may be sealed by a seal 87 such as a bellows, a face seal, a shear seal design, or another type of suitable seal. With output shaft 58 unloaded, opening the control valve 84 causes motor 82 to spin and rotate the stator can 50. The direction and speed of rotation of the motor depends on its helical design. Depending on the specifics of a given application, this embodiment could be used to increase or decrease the speed of rotation of output shaft 58. Similarly, the torque transmitted from collar 52 to output shaft 58 is reacted by motor 82 and depends on the pressure differential across motor 82 which, in turn, is controlled by valve 84. Thus, this embodiment may be employed in a wide range of torque and speed implementations.

In another embodiment, the actuation control system 38 may comprise an electrical motor-generator (instead of the hydraulically actuated mud motor) to control the movement of the stator can 50 relative to the collar 52. In a related arrangement, the stator can 50 can be designed to act as a rotor (using magnets or field coils) in an electromagnetic braking system. In this type of system, the relative movement of the stator can 50 is affected by braking coils which may be embedded in the collar 52. Heat generated by the coils may be distributed along the collar 52 and dispersed to the flowing mud.

Figure 8:
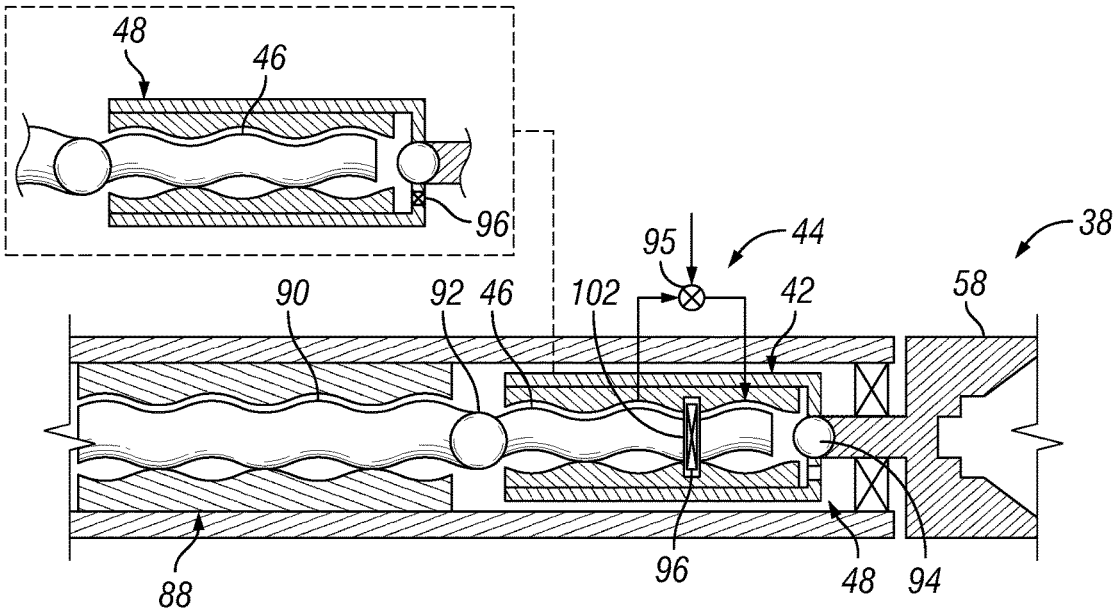
FIG. 8 is a schematic illustration of another example of an actuation control system, according to an embodiment of the disclosure.

Referring generally to FIG. 8, another embodiment of actuation control system 38 is illustrated in which the mud motor 42 serves as a transmission which provides servo control for a corresponding mud motor 88. In this example, the corresponding mud motor 88 may be a conventional mud motor power section which is coupled to rotor 46 of mud motor 42 by a rotor 90 and a flexible coupling 92. Additionally, the stator system 48 is connected to the output shaft 58 through another flexible coupling 94. A flow control valve 95 and an internal flow barrier 96 may be disposed along rotor 46 in a manner such that when a torque is applied due to the fluid passing through the corresponding mud motor 88, the fluid also is pumped against the internal flow barrier 96. The fluid acting against internal flow barrier 96 causes the mud motor 42 to become hydraulically locked (braked) and is thus capable of transmitting torque. In this example, internal flow barrier 96 may work in cooperation with valve 95 which allows flow to pass from the left side of the barrier 96 to the right side, thus determining the pressure drop and the torque transmitted. In the upper left inset example, the internal flow barrier 96 also serves as the flow control and acts as both barrier and valve point where flow can be choked to achieve the desired torque.

The control system 44 may be used in cooperation with a seal 102, as illustrated in FIG. 8. Control system 44 allows the mud motor/transmission-brake 42 to rotate by leaking off the compressed fluid to the main flow. The amount of slippage/relative rotation may be controlled to achieve the required output shaft speed similar to the stator can embodiments described above. Additionally, the transmission-brake design can be transformed into an electrical or mud powered motor design employing the stator can arrangement.

Various embodiments described herein also may be employed as torque limiters. The pressure drop through a mud motor is related to torque. Consequently, data from a torque sensor or from a sensor measuring differential pressure across the motor can be used to arrange for the stator can 50 to slip above a predefined torque setting. With an active control system 44, this torque threshold can be varied dynamically to suit changing demands. Additionally, the torque setting may be supplied by another control system, such as a supervisory system. By way of example, in a wired drill pipe network system, the torque setting may be dynamically varied to achieve at least some overall system damping of torsional vibration.

Figure 9:
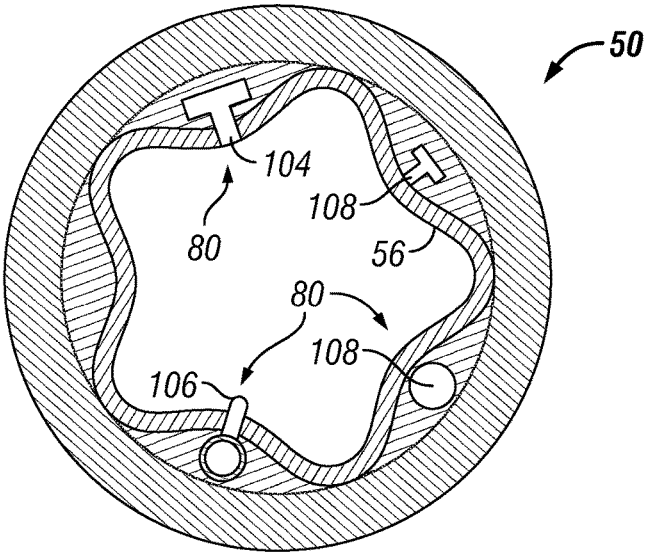
FIG. 9 is an illustration of a plurality of sensors deployed to sense parameters related to operation of the actuation control system, according to an embodiment of the disclosure.

In many of the embodiments described herein, various parameters may be measured to facilitate use of the actuation control system 38. A variety of sensors 80 may be employed to sense and to measure parameters such as pressure, torque, rotation, and/or angular velocity. As illustrated in FIG. 9, at least some of these sensors 80 may be mounted on or embedded in stator can 50. By way of example, the sensors 80 mounted in stator can 50 may comprise a pressure sensor 104, a torque sensor 106, and a rotation or angular velocity sensor 108.

Figure 10:
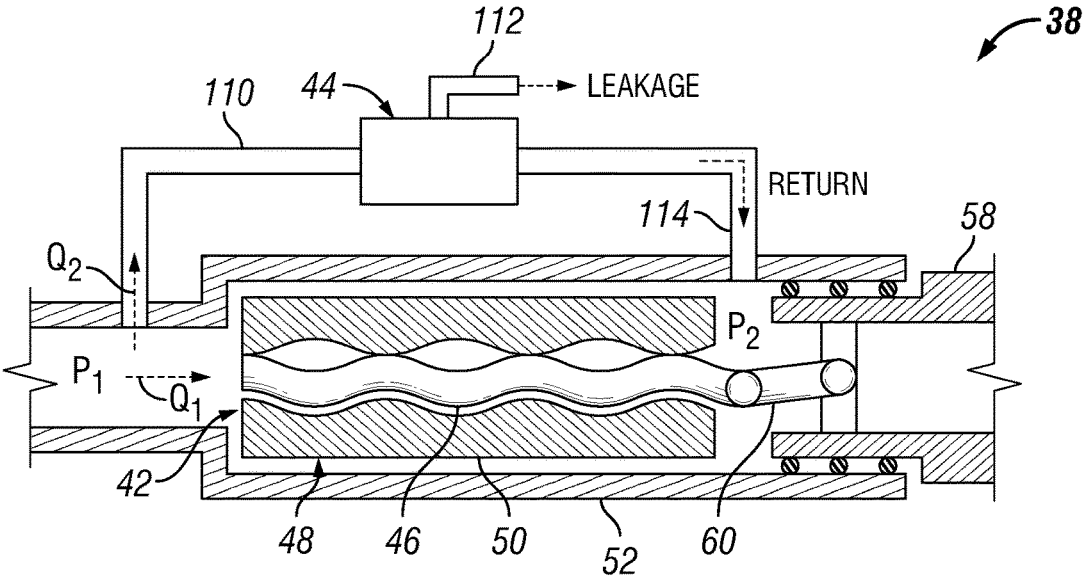
FIG. 10 is a schematic illustration of another example of an actuation control system, according to an embodiment of the disclosure.
Figure 11:
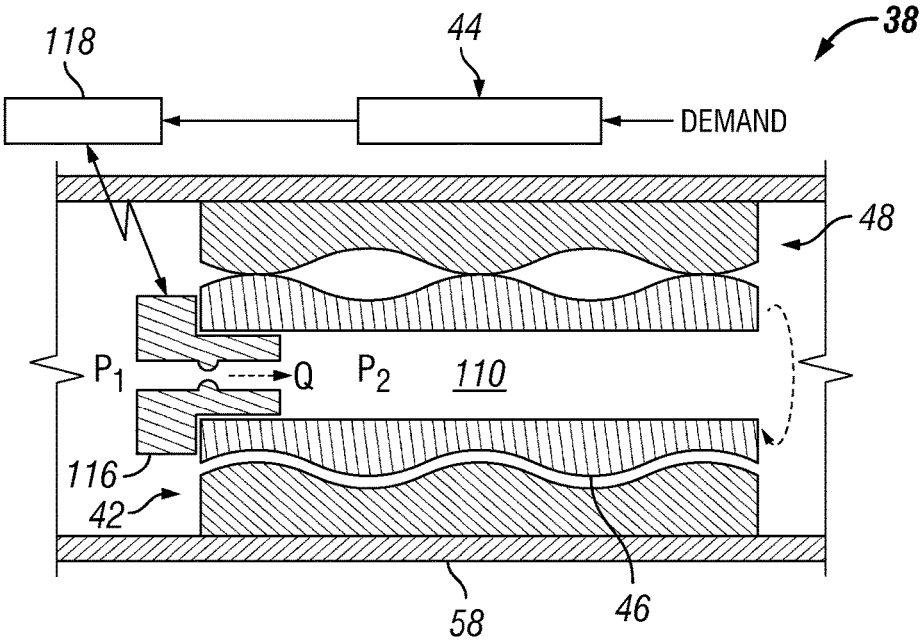
FIG. 11 is a schematic illustration of another example of an actuation control system, according to an embodiment of the disclosure.

Referring generally to FIGS. 10 and 11, additional embodiments of actuation control system 38 are illustrated as incorporating fluid bypasses. As illustrated in FIG. 10, for example, the bypass 110 is connected between an upstream end and a downstream end of stator system 48. Fluid flow, e.g. drilling mud flow, may be selectively diverted through bypass 110 via control system 44 to control the rotation of rotor 46. The bypass 110 may comprise a bypass pipe or other suitable conduit arranged to direct the bypassed fluid flow to a surrounding annulus via a conduit 112 and/or back into the main fluid flow through the tool string via a return port 114. The control system 44 may comprise suitable valves or other flow control devices to leak or bypass the appropriate amount of fluid to ensure a desired rotation of the rotor 46 due to the volumetric displacement of fluid passing between the rotor 46 and the stator system 48. In some applications, the stator system 48 may comprise separately rotatable stator can 50 operated in cooperation with bypass 110. It should be noted the bypass 110 may have a variety of orientations along a variety of routes. For example, the bypass flow can be directed through the collar 52, through the rotor 46, and/or through the stator can 50. By way of example, ports may be arranged in a helical pattern or other suitable pattern extending through one or more of these components to provide a bypass flow path.

In the example illustrated in FIG. 11, the bypass 110 extends through rotor 46. A control valve 116 may be mounted along the flow path through rotor 46 to control the amount of fluid, e.g. drilling mud, diverted from flowing between rotor 46 and stator system 48. The valve 116 may be controlled via control system 44 and may be in the form of a variable choke or other type of suitable flow control device. In some applications, control system 44 may comprise a wireless module 118 employed to communicate with and to power the control valve 116. Such wireless communication can be performed by various systems, such as the WiTricity™ (trademark of WiTricity Corporation) system. The relay of power and/or data may be used to control choke position while also obtaining data on choke position, differential pressure, flow rate, rotor angle, or other parameters. The data can then be used to adjust the valve 116 to achieve the desired bypass of fluid. In some applications, valve 116 and/or module 118 may be used to perform other duties and can be involved in transmitting power and information to other systems described above on or below the actuation control system 38.

Figure 12:
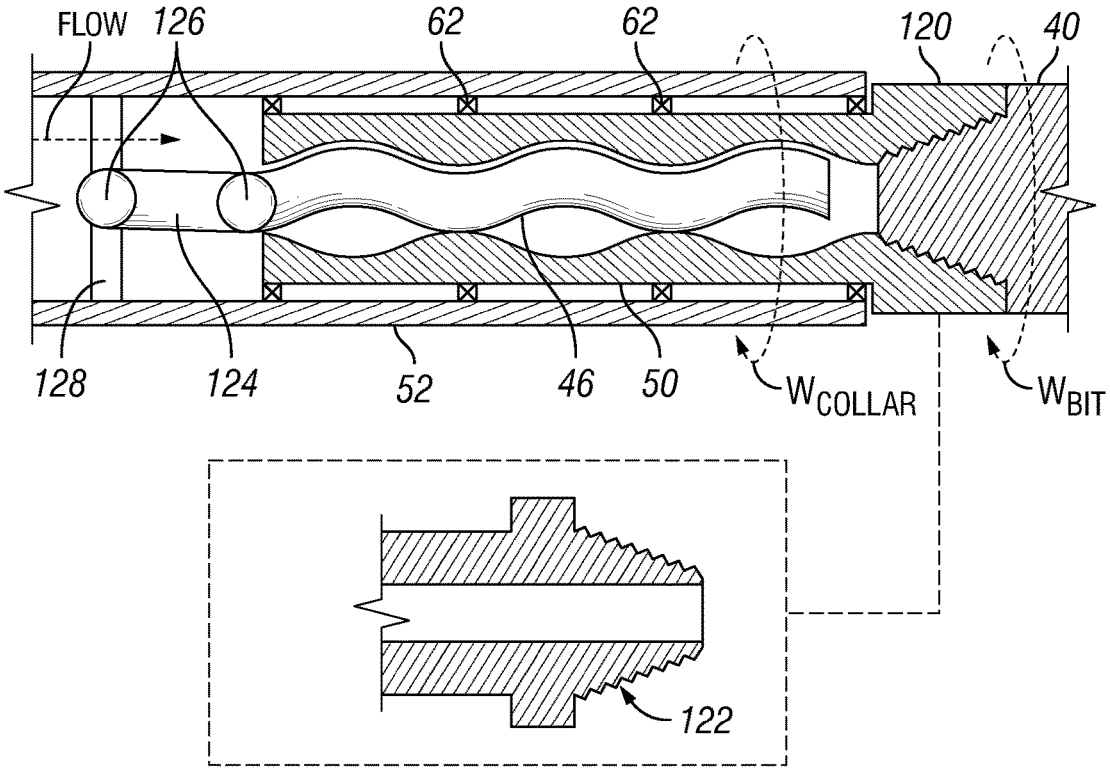
FIG. 12 is a schematic illustration of another example of an actuation control system, according to an embodiment of the disclosure.
Figure 13:
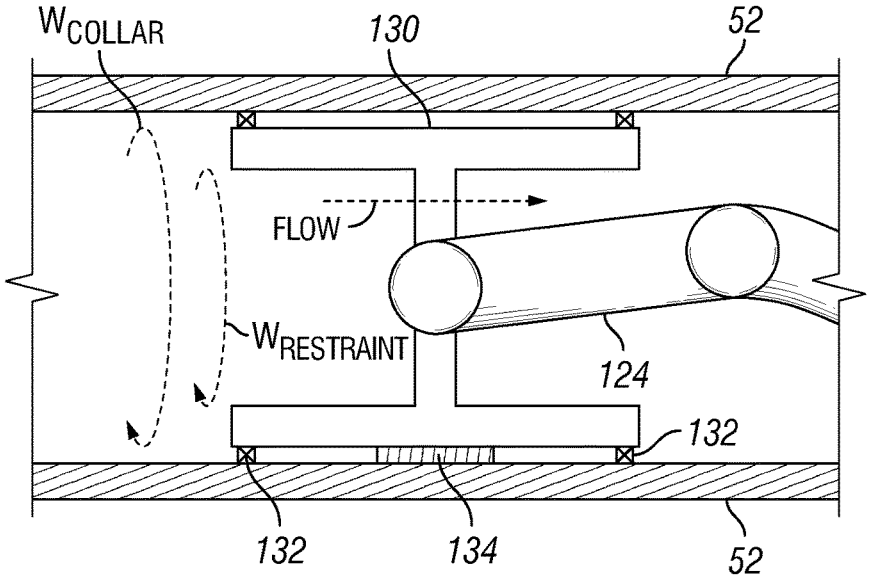
FIG. 13 is a schematic illustration of an example of a rotational restraint system, according to an embodiment of the disclosure.
Figure 14:
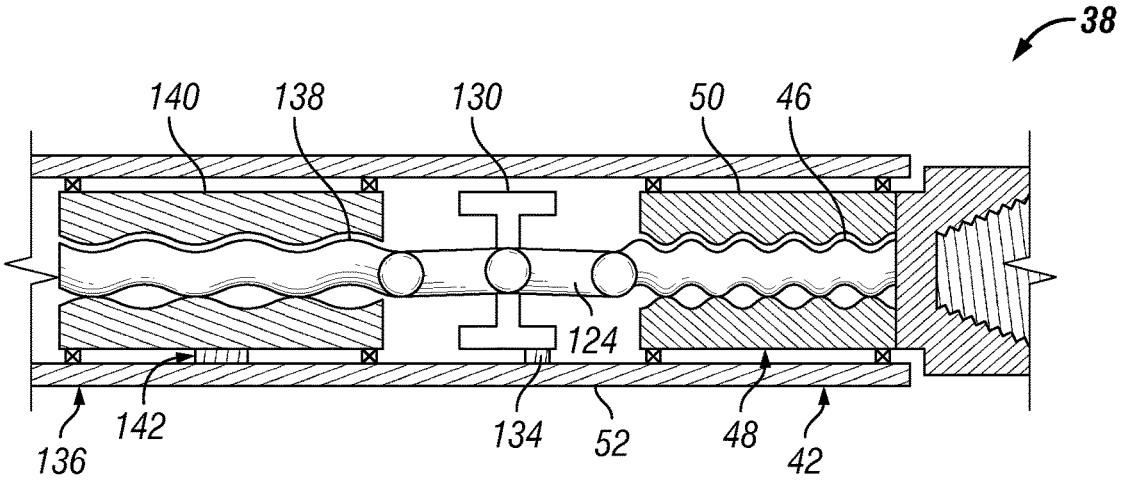
FIG. 14 is a schematic illustration of another example of an actuation control system, according to an embodiment of the disclosure.

Referring generally to FIGS. 12-14, additional embodiments of actuation control system 38 are illustrated. In these embodiments, the stator can 50 is coupled to actuatable component 40 and rotation of the stator can 50 is controlled. Referring initially to the embodiment illustrated in FIG. 12, the stator can 50 may be coupled to a connector end 120 designed for coupling with actuatable component 40. By way of example, connector end 120 may comprise a box end, as illustrated, or a pin end as illustrated in inset 122. In this embodiment the stator can 50 or other outer motor element is rotated by the Moineau motor action.

The rotor 46 is connected with a universal coupling mechanism 124, which may comprise a pair of universal joints 126. However, the universal coupling mechanism 124 may have a variety of forms, including a flex tube, two Hooke's joints, spherical bearings, rotational spines, or other elements which allow the rotor 46 to move laterally while preventing relative rotation with respect to the collar 52. In the illustrated example, the rotor 46 is rotationally constrained relative to collar 52 by a collar restraint 128 connected between coupling mechanism 124 and collar 52. As mud flows through the mud motor 42, the stator can 50 is forced to rotate relative to rotor 46. By rotationally restraining the rotor 46 relative to the collar 52, the motor torque is transmitted to the universal coupling 124, the collar restraint 128, and ultimately to the outer collar 52.

The design illustrated in FIG. 12 provides a strong structural element, in the form of stator can 50, with which to transmit torque. Additionally, the design allows the universal coupling mechanism 124 to be larger because of its placement above the mud motor 42. In this position, the coupling mechanism 124 does not compete for space with a bearing. Additionally, the axial load path through the motor can be transferred across a longer length of motor, and this attribute can be used to reduce the stress on each bearing element. The design of this type of system also provides easily controllable axial positioning of an inner motor element, e.g. rotor 46, relative to an outer motor element, e.g. stator can 50. In a conventional design, the axial position of the rotor relative to the stator depends on a long dimension chain and leads to a very large tolerance of closing dimension, whereas the embodiment illustrated in FIG. 12 practically eliminates this issue. The axial rotor positioning simply depends on the length of the universal coupling joint 124 and the location of the collar restraint 128 relative to the outer collar structure. The universal coupling joint 124 is readily designed with an adjustable length. Thus, varying the length of the joint 124 can be used to axially adjust the inner motor element relative to the outer motor element in a very precise manner.

The embodiment illustrated in FIG. 12 may be used as a servoed motor (as with the embodiments discussed previously) by enabling selective restraint of the universal coupling mechanism 124 with respect to the collar 52. As illustrated in FIG. 13, the universal coupling mechanism 124 may be coupled with a rotating restraint member 130 which is rotatable within collar 52 on bearings 132. A braking mechanism 134 is introduced between the rotating restraint member 130 and the collar 52 to control the torque and rotation transferred to the actuatable device 40, e.g. a drill bit. In a drilling application, for example, the rotation of the drill bit with respect to the rock can be controlled to rotate at different rates relative to the collar 52. The braking mechanism 134 may comprise a hydraulically or electrically actuated friction braking system or a variety of other braking systems, such as the braking systems discussed above. A control system, such as control system 44, may be used to selectively control braking mechanism 134.

A related embodiment is illustrated in FIG. 14 as having a dual motor configuration. In this embodiment, the system is designed as a two speed motor system in which it is possible to switch between a high-speed motor (low torque) and a low speed motor (high torque). By way of example, mud motor 42 may comprise the low speed, high torque motor having the actuatable device 40 coupled to stator can 50. A second, high-speed mud motor 136 is placed above the low speed mud motor 42 and comprises a second rotor 138 rotatably mounted within a second stator can 140 which, in turn, is rotatably mounted within the surrounding collar 52.

The rotor 138 may be coupled to rotor 46 through rotating restraint member 130. In this design, two separate braking mechanisms are utilized. For example, braking mechanism 134 may be positioned between rotating restraint member 130 and collar 52, as described above. An additional braking mechanism 142 is positioned between stator can 140 and the surrounding collar 52. For low speed, high torque operations braking mechanism 142 is off and the control is applied through braking mechanism 134. In this configuration, the high-speed motor 136 is spinning but not providing torque. For high-speed, low torque operations, braking mechanism 134 is off and the control is applied through braking mechanism 142. In this configuration, the low speed motor 42 is still turning at its low speed (effectively adding its speed to that of the high-speed motor 136. However, the overall torque "ceiling" transmitted by the overall system is limited to what the high-speed mud motor 136 provides. It should be noted that various numbers of mud motors may be coupled together in this manner, and the braking mechanisms 134, 142 may be constructed in a variety of configurations and may be located at various points along the system. Additionally, control system 44 may be coupled with the various braking mechanisms 134, 142 and sensors 80 to provide the desired control over the braking mechanisms and over the angular velocity/torque output of the system. For example, if the motors have opposing helical profiles is possible to utilize the system as a downhole actuator capable of both positive and negative speed control.

In operation, the actuation control system 38 may be utilized in a variety of applications and environments. By way of example, the system 38 may be employed to limit the torque transmitted through a given device or to control the torque being transmitted to a defined set-point, even in embodiments in which the set-point is time varying. In some embodiments, the actuation control system 38 may be employed to dampen drill string rotational vibrations, including those associated with stick-slip. The system also may be used to inject torsional loads into the drill string to, for example, apply torsional vibration to a drill bit to enhance drilling speeds. Similarly, the system 38 may be operated to agitate a drill string so as to reduce drill string friction or as a method of freeing a stuck drilling system. The system 38 also may be operated to create torsional waves used in communication/telemetry.

In other applications, the actuation control system 38 may be used to orient the bend of a mud motor to enable directional drilling. The system 38 also may be operated to establish a set speed for a drill bit when drilling to help isolate the drill bit speed from drill string motions, e.g. establishing a constant bit speed in the presence of drill string stick-slip. The actuation control system 38 also can be used to create pressure waves by alternating the braking of system components to provide pressure wave telemetry while also creating fluid and mechanical pressure pulses at the drill bit to enhance drilling speeds.

Additionally, the actuation control system 38 may be constructed in a variety of configurations to facilitate a given operational application, such as those described above. In some embodiments, for example, a plurality of braking systems, e.g. two braking systems, is employed. For example, braking mechanisms such as braking mechanisms 64 and 74, may be positioned and operated to control slippage between the stator can and an upper collar and between an upper collar/housing and a lower collar/housing. Additionally, the downhole actuation control system 38 may be used in cooperation with a surface control system, such as a surface control system for controlling rig mud pump flow rate/pressure, rotary table torque, rpm or angle, drawworks influence over the weight on bit, and/or other surface control features. The coordinated use of the surface control system can serve to reduce the time over which the slipping stator can 50 is operated, thus reducing component wear and heat generation. In some applications, for example, the surface control system may be employed to control nominal conditions via a surface rig and the downhole actuation control system 38 may be used to control the transient conditions and small offset conditions. In this application, the actuation control system 38 may be a servo system which provides coordinated control of a downhole tool in unison with a surface control system, such as the control system on a surface rig. For example, the surface control system may be operated to adjust the mud pump flow rate/pressure, the rotary table torque, the RPM or angle, and/or the weight on bit to assist the downhole servo control system 38 in achieving control objectives. Examples include meeting downhole motion or torque control objectives without incurring damaging levels of heat during operation of the servo control system 38 and while maintaining predetermined variables for other tools in the drill string and mud system.

It should be noted the coordinated surface and downhole systems may utilize bidirectional telemetry to communicate data to and from the respective systems. The bidirectional telemetry may incorporate various types of telemetry features, such as mud pulse telemetry, acoustic transmission, wired drill pipe, electromagnetic telemetry, and/or other suitable telemetry systems and techniques. In some applications, the downhole actuation control system 38 may utilize control module 66 in the form of a drilling mechanics module able to provide high-bandwidth measurements of torque, rpm, pressures and/or other parameters. By way of example, when actuation control system 38 is constructed as a servoed mud motor, torque output data can be used in a feedback arrangement with the mud motor to achieve a desired drilling torque or speed at some other part of the drill string.

The actuation control system 38 also may be designed with a variety of braking systems and braking mechanisms for controlling the interaction of various system components, e.g. rotor, stator can, collar sections, and/or other components. In some applications, at least one of the braking mechanisms 64, 74 or a similar additional braking system may be oriented outwardly to create a torsional drag on the actuation control system 38 via friction with the surrounding borehole. By way of example, such a braking system orients the braking elements, e.g. braking pads, to extend outwardly for interaction with the surrounding borehole wall to create torsional drag against the surrounding borehole wall. The various braking systems may be positioned along, above, and/or below the stator system 48. In operation, the braking system acting against the borehole wall may be controlled to drain undesirable energy from the drill pipe and bottom hole assembly so as to relieve the actuation control system 38, e.g. servoed mud motor, from performing that duty. Each of the braking mechanisms 64, 74 and any additional braking mechanisms can be controlled via control module 66, via surface control, or via a combination of downhole and surface control.

The actuation control system 38 may be utilized in controlling the actuation of many types of components in a variety of applications, as described above. By way of additional examples, the actuation control system 38 may be used to control components mounted at the end of the rotor, e.g. rotor 46. In such an embodiment, the actuation control system may be used to control actuation of a valve mounted at the end of rotor 46, and the control may be accomplished via wireless communication or other suitable telemetry techniques.

Additionally, the actuation control system 38 may utilize the rotating stator can system 44 with stator can 50 to dampen drill string vibration. In some applications, the rotating stator can system 44 also may be controllably actuated to serve as an orienter. In some applications, the rotating stator can system 44 may be used as an agitator, or the system may be coupled to components designed to generate electricity. By way of further example, the rotating stator can system 44 may be employed to control loads, torques, and/or speeds of a drill bit when drilling and when off the bottom to reduce whirl or to otherwise improve drill bit operation. The rotating stator can system 44 also may be used to generate energy for use in facilitating telemetry.

Embodiments described herein also may be used in reverse for a variety of pumping applications. In such applications, the shaft 58 may be used as a drive for actuating a pump. If the actuation control system 38 comprises two motors, some embodiments and applications may utilize operation of the motors in opposite rotational directions. Additionally, the rotating stator can 50 may be used for services within the drill pipe or colors. For example, the rotating stator 50 may be used in a bit shaft servo or an electrical generator. A variety of other uses and applications also may benefit from the control capabilities of actuation control system 38.

Depending on the application, the actuation control system also may utilize a variety of progressing cavity systems in several configurations and arrangements. The progressing cavity systems may be used individually or in combination as Moineau style motors or pumps. In drilling applications and other downhole applications, the progressing cavity system or systems may be in the form of mud motors or mud pumps which are powered by the flow of drilling mud or by another type of actuation fluid. In many applications, the mud motors may utilize thin-walled motor technology, however a variety of stator, rotor and/or collar designs may be utilized. Additionally, various types of braking mechanisms may be constructed and arranged in several types of configurations. The braking mechanisms may be powered hydraulically, electrically, or by other suitable techniques. Additionally, various control systems, e.g. microprocessor-based control systems, may be employed to control the progressing cavity system or systems. Many types of sensors also may be employed in a variety of sensor systems to provide data to the control system regarding, for example, angular velocity and torque output. Moineau motor principles have been described herein, however the same concepts apply to similar embodiments utilizing the turbine motor principle. In applications where two or more motors have been used, for example, at least one of the motors can be constructed to operate according to turbine motor principles.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for controlling actuation, comprising:

a collar;

a stator can rotatably mounted in the collar such that the stator is selectively rotatable relative to the collar;

a rotor rotatably mounted in the stator can and coupled to an actuatable component, the rotation of the rotor relative to the stator can having a correlation with the volumetric displacement of fluid passing between the rotor and the stator can, wherein a torque transmitted to the actuatable component from the rotor is proportional to a torque transmitted from the stator can to the collar; and a control system which controls the relative rotation of the stator can with respect to the collar by controlling the torque transmitted from the stator can to the collar.

2. The system as recited in claim 1, wherein the actuatable component is also coupled to the stator can.

3. The system as recited in claim 1, further comprising:

a second stator can; and a second rotor coupled to the rotor.

4. The system as recited in claim 1, wherein the control system comprises a pressure actuated brake which selectively reduces slippage between the stator can and the collar.

5. The system as recited in claim 1, wherein the control system comprises an electrically actuated brake which selectively reduces slippage between the stator can and the collar.

6. The system as recited in claim 1, wherein the control system comprises a plurality of friction plates against which the stator can is moved to reduce slippage between the stator can and the collar.

7. The system as recited in claim 1, where the control system comprises a mud motor which selectively reduces slippage between the stator can and the collar.

8. The system as recited in claim 1, wherein the control system comprises a magneto-rheological fluid acting between the stator can and the collar.

9. The system as recited in claim 1, further comprising a plurality of sensors positioned to detect torque and angular velocity of at least one of the rotor and the stator can.

10. The system as recited in claim 1, wherein the control system comprises an electromagnetic brake actuatable to selectively reduce slippage between the stator can and the collar.

11. The system of claim 1, further comprising a rotation-controlling device positioned between the stator can and the collar, the control system being configured to modulate the rotation-controlling device so as to control rotation of the stator can relative to the collar and thereby control an angular position of a driveshaft of the actuatable component relative to a rock formation.

12. The system of claim 11, wherein the control system is configured to control a rotation speed of the rotor by modulating the rotation-controlling device between the stator can and the collar.

13. The system of claim 11, wherein the control system is configured to control the torque applied to the actuatable component by modulating the rotation-controlling device between the stator can and the rotor.

14. A system for controlling actuation comprising:

a collar;

a stator mounted at least partially in the collar such that the stator is selectively rotatable relative to the collar;

a rotor rotatably mounted at least partially in the stator and coupled to an actuatable component, the rotation of the rotor relative to the stator corresponding with the volumetric displacement of fluid passing between the rotor and the stator, wherein a torque transmitted to the actuatable component from the rotor is proportional to a torque transmitted from the stator to the collar;

a control system configured to control the relative rotation of the stator with respect to the collar by varying the torque transmitted from the stator to the collar;

a fluid bypass; and a flow control system coupled to the bypass to control the amount of fluid diverted through the bypass instead of flowing between the rotor and the stator.

15. The system as recited in claim 14, wherein the bypass extends through an interior of the rotor.

16. The system as recited in claim 14, wherein the bypass is oriented to direct fluid into a wellbore annulus.

17. The system as recited in claim 14, wherein the rotor and the stator are part of a drill string and the bypass is oriented to direct fluid back into the drill string.

18. A method for providing control in a wellbore, comprising:

providing a rotor and a stator can with cooperating surfaces such that rotation of the rotor relative to the stator can depends on the volumetric displacement of fluid passing between the rotor and the stator can, wherein the rotor is coupled to an actuatable device such that rotation of the rotor causes at least a portion of the actuatable device to rotate;

rotatably mounting the stator can within a collar so the stator can may be allowed to rotate with respect to the collar during the volumetric displacement of fluid passing between the rotor and the stator can; and controlling the amount of slippage between the stator can and the collar to create a downhole actuation control system which controls the relative action between the rotor and the stator can, wherein a torque transmitted by the rotor to the actuatable device is proportional to a torque transmitted between the stator can and the collar.

19. The method as recited in claim 18, wherein controlling comprises controlling a bypass flow of the fluid past the rotor and the stator can.

20. The method as recited in claim 18, wherein controlling further comprises controlling at least one of the torque and the angular rotation of the rotor relative to the collar.

21. The method as recited in claim 18, further comprising utilizing a surface control system in combination with the downhole actuation control system.

22. The method as recited in claim 18, wherein controlling comprises at least one of: dampening a drill string vibration, orienting a component, agitating with a component, thrusting with a component, generating electricity, controlling loads on a drill component, powering a telemetry system, powering a pump, and powering a downhole component.

23. The method as recited in claim 18, wherein providing comprises providing a plurality of rotors and a plurality of stator cans to create a pair of progressing cavity motors; and operating the motors in opposite rotational directions.

24. The method of claim 18, further comprising controlling a rotation speed of the rotor, or a torque of the rotor, or both, by modulating a rotation-controlling device between the stator can and the collar.

* * * * *